US007270560B1

(12) United States Patent
Bodmann et al.

(10) Patent No.: US 7,270,560 B1
(45) Date of Patent: Sep. 18, 2007

(54) USB CONNECTOR LOCKING DEVICE WITH LOCK PRONGS OR MOVABLE LOCK RING

(75) Inventors: Douglas R. Bodmann, Shaker Heights, OH (US); Douglas J. Dura, North Royalton, OH (US); William B. Foster, Jr., Stow, OH (US); Douglas A. Lostoski, Richfield, OH (US); William M. Ruddy, Chardon, OH (US)

(73) Assignee: Rockwell Automation Technologies, Inc., Mayfield Heights, OH (US)

( * ) Notice: Subject to any disclaimer, the term of this patent is extended or adjusted under 35 U.S.C. 154(b) by 0 days.

(21) Appl. No.: 11/416,764

(22) Filed: May 3, 2006

(51) Int. Cl.
*H01R 13/627* (2006.01)

(52) U.S. Cl. ..... 439/355

(58) Field of Classification Search ..... 439/353, 439/357, 355, 358, 350, 142
See application file for complete search history.

(56) References Cited

U.S. PATENT DOCUMENTS

| | | | | |
|---|---|---|---|---|
| 3,551,880 | A * | 12/1970 | Hartwell | 439/314 |
| 3,745,511 | A * | 7/1973 | Fussell | 439/294 |
| 4,547,032 | A * | 10/1985 | Burns et al. | 439/314 |
| 5,286,213 | A * | 2/1994 | Altergott et al. | 439/139 |
| 6,354,852 | B2 * | 3/2002 | Noro et al. | 439/157 |
| 6,626,699 | B1 * | 9/2003 | Epe et al. | 439/527 |
| 6,902,428 | B2 * | 6/2005 | Wong | 439/528 |
| 6,902,432 | B2 * | 6/2005 | Morikawa et al. | 439/607 |
| 7,077,698 | B2 * | 7/2006 | Matthys et al. | 439/557 |
| 7,128,586 | B2 * | 10/2006 | Kung | 439/133 |
| 2005/0070138 | A1 | 3/2005 | Chiou et al. | |
| 2005/0233639 | A1 * | 10/2005 | Blosch et al. | 439/587 |
| 2006/0061953 | A1 | 3/2006 | Le | |
| 2006/0064534 | A1 | 3/2006 | Lanus et al. | |
| 2006/0141843 | A1 * | 6/2006 | Huang et al. | 439/350 |

OTHER PUBLICATIONS

*Universal Serial Bus Specification Revision 2.0*, Chapter 6, pp. 85-118, Apr. 27, 2000.

* cited by examiner

*Primary Examiner*—Chandrika Prasad
(74) *Attorney, Agent, or Firm*—Steven M. Haas; Alexander R. Kuszewski

(57) ABSTRACT

A universal serial bus (USB) locking connector includes a cable, a polymeric body connected to the cable, and a metallic male plug that projects axially from the body. One or more locking prongs extend axially alongside but are spaced from the male plug and are resiliently deflectable toward and away from the male plug. Each locking prong includes a leg having an outer end, and an enlarged tooth defined at the outer end. The enlarged tooth includes an inclined ramp surface and a transverse locking face. When the USB locking connected is mated with a conventional female USB connector, the locking prongs engage a peripheral edge of the female connector and capture the locking connector to the female connector to provide resistance to axial pull-out. In another arrangement, a USB connector locking system includes a female USB connector installed in a housing. A lock ring is movably connected to the housing adjacent the peripheral edge of the female USB connector. The lock ring is manually movable between an unlocked position and a locked position. When moved to its locked position, the lock ring frictionally engages an associated male USB connector that is mated with the female USB connector to inhibit disconnection of the associated male USB connector from the female USB connector.

8 Claims, 8 Drawing Sheets

USB CONNECTOR LOCKING DEVICE WITH LOCK PRONGS OR MOVABLE LOCK RING

BACKGROUND

Universal Serial Bus (USB) connectors are well-known and in widespread use, in particular, in association with peripheral devices of with computer systems. Specifications for USB connectors are described in full detail in Universal Serial Bus Specification, which can be found at www.usb.org and the disclosure of which is hereby expressly incorporated by reference into this specification. Chapter 6 of the Universal Serial Bus Specification document relates to mechanical features of USB connectors and cables.

USB connectors have many desirable features and advantages as compared to predecessor connectors. A disadvantage, however, is a relatively low resistance to unintended disconnection due to incidental axial pull-out forces, e.g., when a cable is inadvertently pulled or snagged. In many environments, unintended disconnection of a USB connector is a mere nuisance, while in other applications, unintended cable disconnection can have more serious consequences.

This susceptibility of a USB connector to unintended disconnection due to axial pull-out force is associated with both Type A (Host) and Type B (Device or Slave) connectors. FIGS. 1A, 1B and 1C illustrate a conventional USB Type B connector 10 located at a distal end of a USB cable 12. The connector 10 is a male connector adapted to mate with a female USB Type B connector 14 (FIG. 1D) as is well-known in the art. The female connector 14 is connected to a housing H and comprises an inner plug portion 14*p* located within a recess 14*r* that is bounded by a peripheral edge 14*e* of the housing H so that a space 14*s* is defined between the plug portion 14*p* and the edge 14*e*. The inner plug portion 14*p*, itself, comprises a non-symmetric hexagonal receiver 14*p*1 and a rectangular stud 14*p*2. The receiver 14*p*1 is adapted to receive the mating hexagonal male plug portion 22 of the male connector 10, while the rectangular stud 14*p*2 is received inside the male plug portion 22 of the connector 10.

The male USB Type B connector 10 comprises a polymer body portion 20 and metallic male plug portion 22 that projects outwardly from the body portion 20. The body portion 20, itself, comprises a main portion 20*a* and a cable interface portion 20*b* that joins the main portion 20*a* to the cable 12. The main portion 20*a* is enlarged relative to both the cable interface portion 20*b* and the metallic plug portion 22 and, as such, the body portion 20 further comprises inner and outer transverse shoulders 20*i*, 20*t* that join the main portion 20*a* to the cable interface 20*b* and metallic plug portion 22, respectively.

FIG. 1E illustrates the conventional male USB Type B connector 10 and a conventional device M, e.g., an industrial automation module. The device M comprises a female Type B USB connector 14. The male Type B USB connector 10 is adapted to be mated with the female connector 14. Except for a friction fit between the metallic plug portion 22 of the connector 10 and the female plug portion 14*p* (FIG. 1D) of the female connector 14, there is no structure for locking the male Type B USB connector 10 to the female Type B USB connector 14. As noted, the connector 10 is thus susceptible to undesired disconnection in response to incidental axial pull-out force as can occur, e.g., when the cable 12 is pulled for any reason such as during cleaning, maintenance, movement of related components, entanglement with moving structures, etc.

SUMMARY

In accordance with a first aspect of the present development, a universal serial bus (USB) locking connector a cable and a polymeric body connected to the cable. The body includes a main portion and a cable interface portion that interconnects the main portion to the cable. A male plug projects axially from the main portion of the body, wherein a shoulder is defined between said male plug and said main portion of the body. At least one locking prong extends axially alongside but is spaced from the male plug and is resiliently deflectable toward and away from the male plug. The at least one locking prong includes: (i) a leg having an outer end spaced axially from the shoulder; and, (ii) an enlarged tooth defined at the outer end of the leg. The enlarged tooth includes an inclined ramp surface that is arranged to converge from a highest point toward an outermost end of the male plug as it extends axially away from the shoulder of the body portion. A transverse locking face terminates the ramp surface at the highest point.

In accordance with another aspect of the present development, a USB connector locking system includes a female USB connector installed in a housing. The female USB connector includes an inner plug portion located within a recess that is bounded by a peripheral edge defined in a wall of the housing H, with a space defined between the inner plug portion and the peripheral edge. A lock ring is movably connected to the wall of the housing adjacent the peripheral edge of the female USB connector. The lock ring is manually movable between an unlocked position and a locked position. The lock ring, when located in its unlocked position, allows unobstructed connection and disconnection of an associated male USB connector with the female USB connector. When the lock ring is moved to its locked position, it frictionally engages an associated male USB connector that is mated with the female USB connector to inhibit disconnection of the associated male USB connector from the female USB connector.

BRIEF DESCRIPTION OF THE DRAWINGS

The development comprises components and arrangements of components, and/or steps and arrangements of steps, preferred embodiments of which are disclosed herein and shown in the drawings that form a part hereof, wherein.

DETAILED DESCRIPTION

Figure 2:
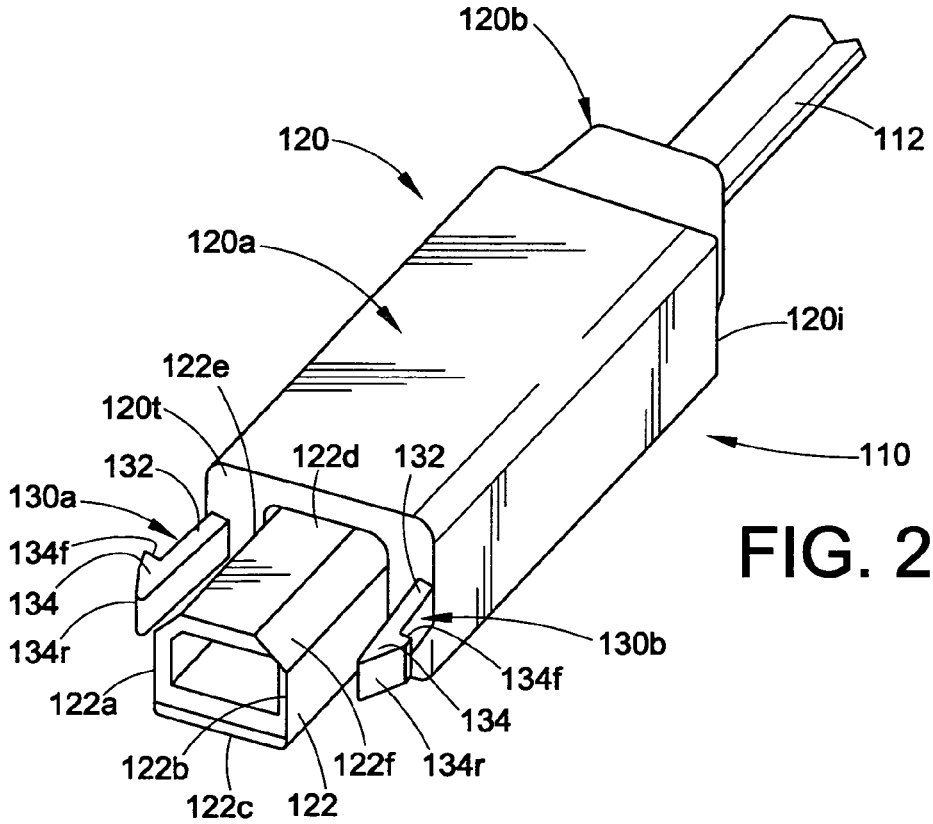
FIG. 2 is an isometric view of a male Type B USB locking connector formed in accordance with the present development.

FIG. 2 illustrates a male Type B USB locking connector 110 formed in accordance with the present development. The connector 110 is identical to the conventional connector 10 as just described, except that the connector 110 comprises locking means for engaging a conventional mating female Type B USB connector 14 so as to be resistant to disconnection in response to incidental axial pull-out forces. The locking connector 110 comprises a polymer body portion 120 and metallic male plug portion 122 that projects outwardly from the body portion 120. The body portion 120, itself, comprises a main portion 120*a* and a cable interface portion 120*b* that joins the main portion 120*a* to the cable 112. The main portion 120*a* is enlarged relative to both the cable interface portion 120*b* and the metallic plug portion 122 and, as such, the body portion 120 further comprises inner and outer transverse shoulders 120*i*,120*t* that join the main portion 120*a* to the cable interface 120*b* and metallic plug portion 122, respectively.

Figure 1A:
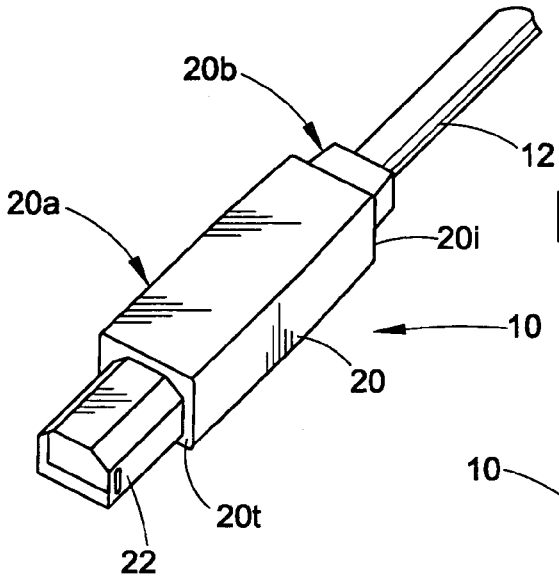
FIG. 1A (PRIOR ART)
FIG. 1A is an isometric view of a conventional male Type B USB connector and cable.
Figure 1B:
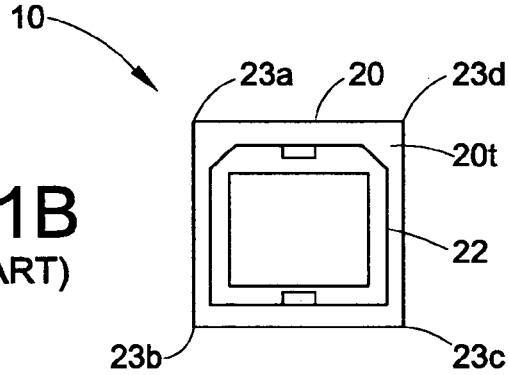
FIG. 1B (PRIOR ART)
FIGS. 1B and 1C are front and side views of the USB connector shown in FIG. 1A.
Figure 1C:
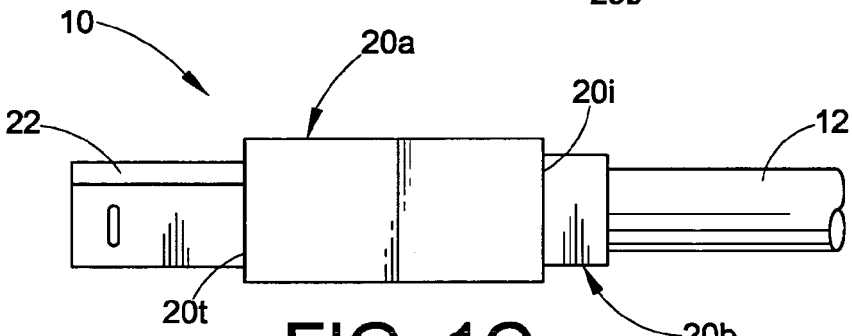
FIG. 1C (PRIOR ART)
Figure 1D:
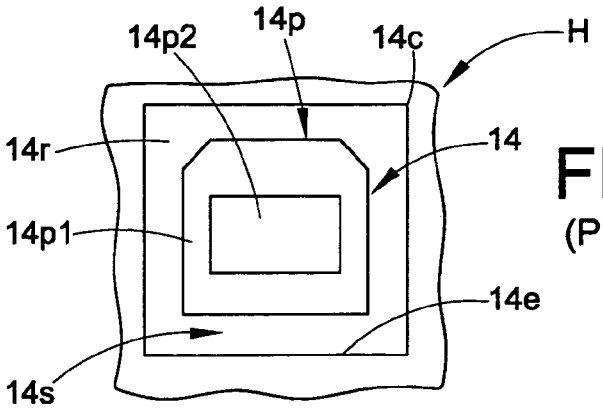
FIG. 1D (PRIOR ART)
FIG. 1D is a plan view of a conventional female Type B USB connector.
Figure 1E:
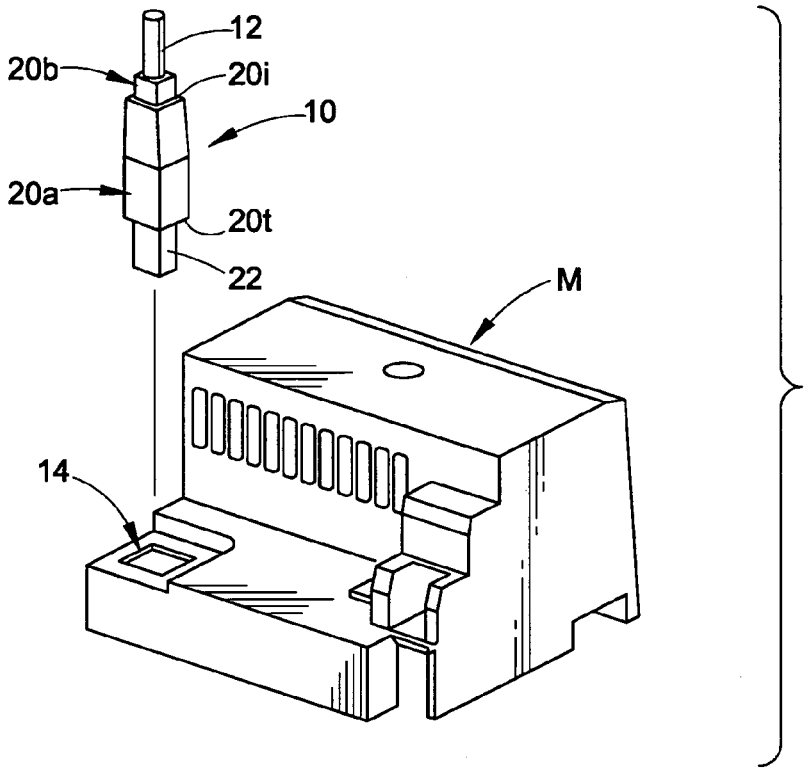
FIG. 1E (PRIOR ART)
FIG. 1E is an exploded view that illustrates the conventional male connector of FIG. 1A and an electrical device that includes the mating female connector of FIG. 1D.

In addition, the locking connector 110 comprises at least one locking prong adapted to be received by and engaged with a conventional female Type B USB connector 14 (FIG. 1D). As shown, the locking connector 110 comprises first and second locking prongs 130*a*,130*b* that project axially outward from the shoulder 120*t*, near to but spaced from and diverging slightly from the metallic plug portion 122. Preferably, the locking prongs 130*a*,130*b* are mirror images of each other and are symmetrically located on opposite sides of the male plug portion 122.

The first and second locking prongs 130*a*,130*b* are preferably defined as a one-piece molded polymeric construction as part of the body portion 120, from a suitable material such as, e.g., polycarbonate, polypropylene or other polymer material. Owing to their molded polymeric construction, the locking prongs 130*a*,130*b* are naturally resiliently deflectable from a home or free position as shown, inwardly and outwardly toward and away from each other and the metallic plug portion 122. The locking prongs 130*a*,130*b* each comprise a leg 132 having an inner end that originates at the shoulder 120*t* and an outer end spaced axially from the shoulder 120*t* and defining an enlarged tooth 134. Each tooth 134 includes an inclined ramp surface 134*r* that is arranged to converge from a highest point 134*p* (see FIG. 5) toward the outermost end of the male plug portion 122 as it extends axially away from the shoulder 120*t* of the body portion 120. A transverse locking face 134*f* (see also FIG. 5) extends between the highest point 134*p* of each ramp surface 134*r* and the leg 132, i.e., the transverse locking face 134*f* terminates the inclined ramp surface 134*r* at its highest point 134*p*. The metallic plug portion 122, defines a hexagonal cross-section including first and second parallel, equal-length lateral sides 122*a*,122*b*, bottom and top parallel sides 122*c*,122*d* of unequal length, and first and second non-parallel, equal-length transitional sides 122*e*,122*f* that connect the top side 122*d* to the first and second lateral sides 122*a*,122*b*, respectively. It is most preferred that the locking prongs 130*a*,130*b* be located respectively adjacent but spaced from the first and second lateral sides 122*a*,122*b* of the metallic connector 122, although other locations are contemplated and deemed to be within the scope of the present development. The locking connector 110 mates with a convention female Type B USB connector 14 in the same manner as the conventional male Type B USB connector 10, except that the one or more locking prongs 130*a*,130*b* resiliently engage the peripheral edge 14*e* of the housing H, in particular, with the transverse locking face 134*f*.

Figure 3A:
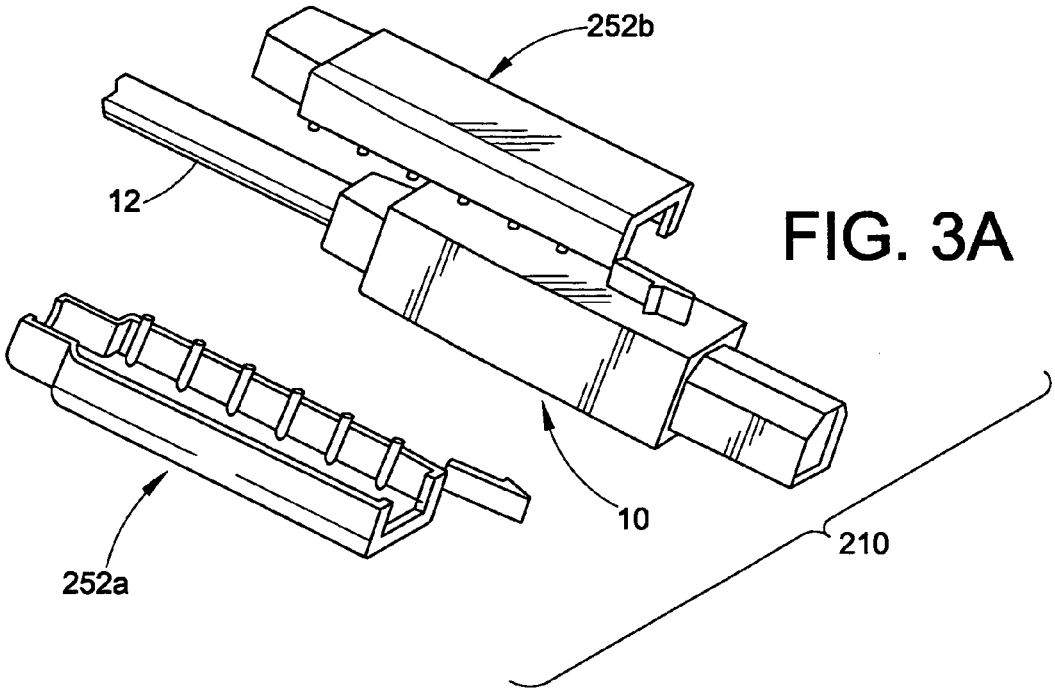
FIG. 3A is an exploded isometric view of an alternative male Type B USB locking connector formed in accordance with another embodiment of the present development.
Figure 3B:
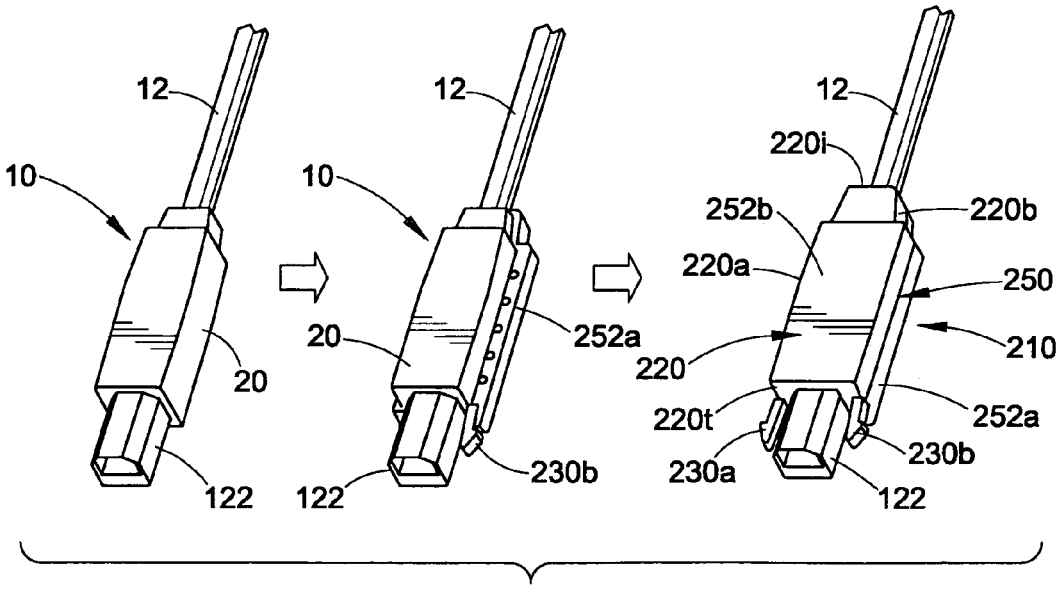
FIG. 3B is a series of views that illustrate conversion of the conventional male Type USB connector of FIG. 1A to the locking connector of FIG. 3A.

FIGS. 3A and 3B illustrate an alternative locking male Type B USB connector 210 formed in accordance with the present development. The locking connector 210 comprises a conventional male Type B connector 10, and further comprises an outer housing 250 that is connected to and overlies the body 20 of the conventional connector 10 to convert the conventional connector to a locking connector. The housing 250 comprises one or more locking prongs 230*a*,230*b* that have the same structure and location, and that function in the same manner as the respective locking prongs 130*a*,130*b* of the locking connector 110. The housing 250 comprises first and second clamshell components 252 that are fitted around the body 20 of the conventional connector 10 and interconnected so as to define the housing 250 (the first and second clamshell components are identified herein as 252*a*,252*b*).

Those of ordinary skill in the art will recognize that the fully assembled locking connector 210 has the same structure and functions in the same manner as the locking connector 110 and, as such, like components relative to the connector 110 are identified with like reference numbers that are 100 greater than those used in association with the locking connector 110. In particular, the locking connector 210 includes a body 220 having a main portion 220*a* and a cable interface portion 220*b*. A metallic plug portion 222 (which is the metallic plug portion 122 of the underlying conventional connector 10) projects axially outward from the body 220. An inner shoulder 220*i* is defined by the transition between the main portion 220*a* of the body and the cable interface portion 220*b*. An outer shoulder 220*t* is defined between the main body portion 220*a* and the metallic plug 222. As noted above, the first and second locking prongs 230*a*,230*b* correspond respectively to the locking prongs 130*a*,130*b* of the locking connector 110.

The clamshell component 252 is shown by itself in FIGS. 6A-6D. As noted, two of the clamshell components 252 (252*a*,252*b*) are mated to define the housing 250 of the locking connector 210. The clamshell component 252 is defined as a one-piece molded polymeric construction from a suitable material such as polycarbonate or the like. It comprises a shell 260 defining a recess 262 that is conformed to receive the body 20 of the conventional connector 10 therein as shown with reference to the first clamshell component 252*a* in FIG. 3B. The body 20 is received in the recess 262 with a close fit that minimizes or eliminates any movement of the body 20 in the recess 262. The clamshell component 252 also comprises first and second notches 264*a*,264*b* that accommodate the plug 22 and cable 12 of the conventional connector 10. A second clamshell component 252*b*, which has the identical structure as the first clamshell component 252*a*, is installed onto the body 20 of the conventional connector 10 and mated with the first clamshell component 252*a*, with a snap-fit and/or using an adhesive or other bonding means.

The clamshell component 252 comprises interlocking means so that two of the components 252 can be interfitted to define the housing 250. As shown, the clamshell component 252 comprises a plurality of locking studs 270 and a corresponding plurality of locking stud receivers 272. The locking studs 270 of a first clamshell component 252*a* are adapted to mate with and be releasably engaged and retained by the locking stud receivers 272 of a second clamshell component 252*b* and vice versa with a snap-fit or friction-fit, for releasably connecting the components 252*a*,252*b* together to define the housing 250. Use of adhesive or other bonding means is optional.

The illustrated clamshell component 252 comprises a single locking prong 230. When first and second clamshell components 252*a*,252*b* are mated in opposed facing relation to define the housing 250, the locking prongs 230 of the clamshell components 252*a*,252*b* define the first and second locking prongs 230*a*,230*b* described above.

Figure 4:
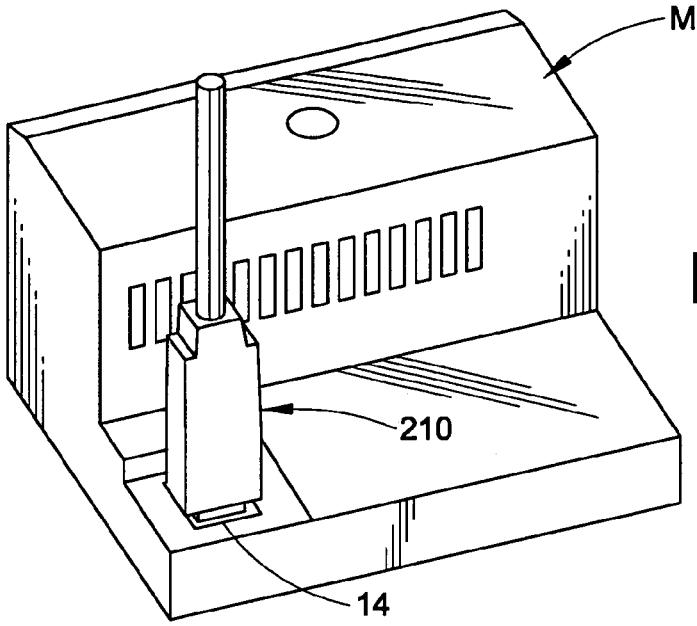
FIG. 4 illustrates the electrical device with a conventional female Type B USB connector as shown in FIG. 1E, but shows the male locking connector of FIG. 3A mated with the female connector in accordance with the present development.
Figure 5:
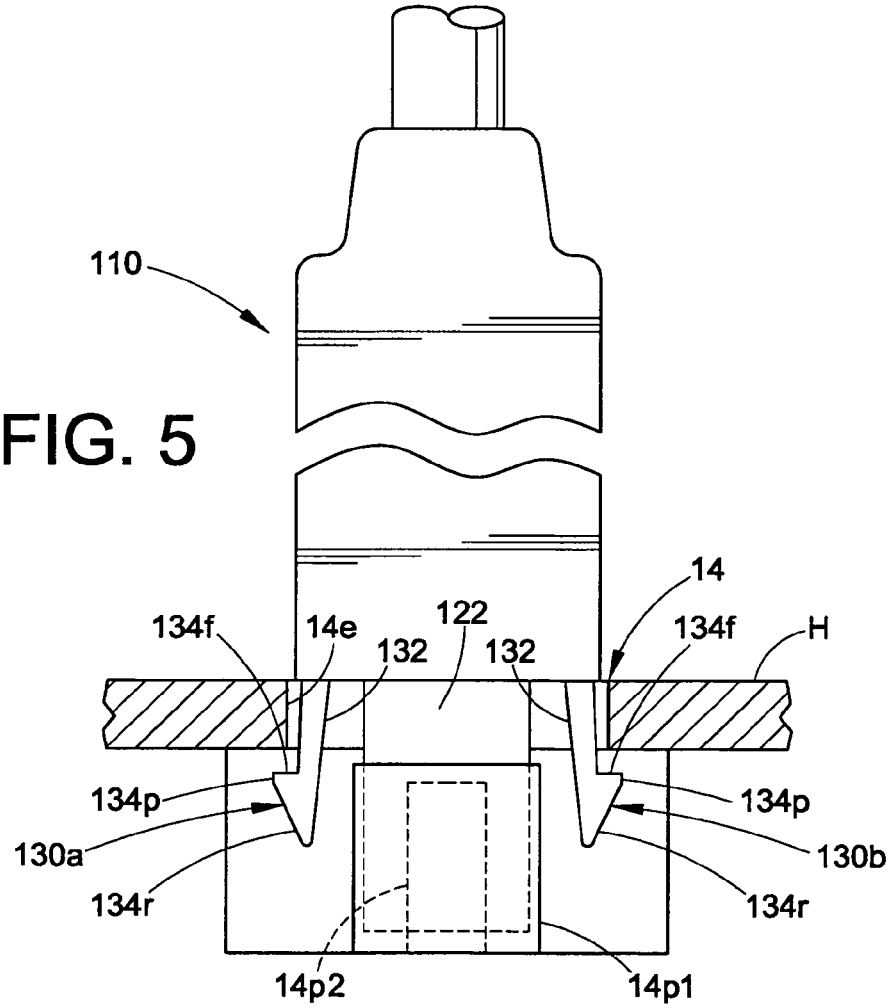
FIG. 5 diagrammatically illustrates a male Type B USB locking connector formed in accordance with the present development engaged with a conventional female Type B USB connector.
Figure 6A:
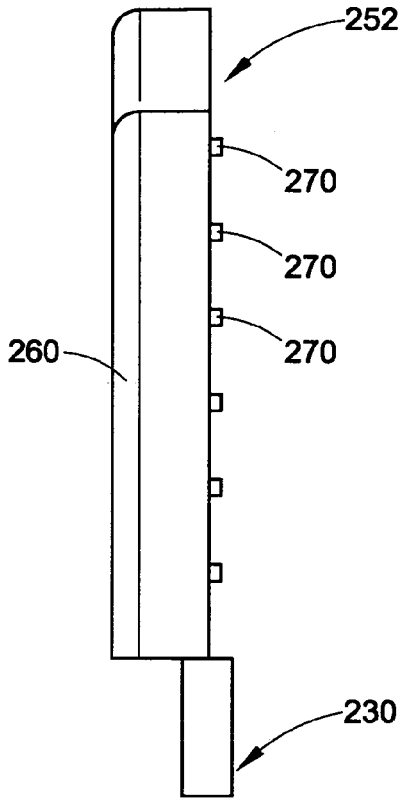
FIGS. 6A, 6B, 6C and 6D are respective side, front, end and isometric views of a clamshell component, first and second ones of which are used to convert a conventional male Type B USB connector to a male Type B USB locking connector in accordance with the present development.
Figure 6B:
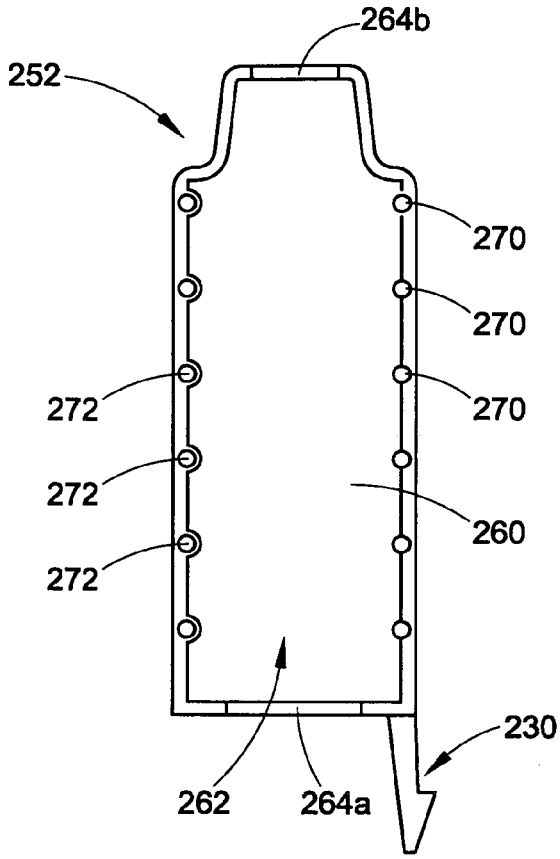
Figure 6C:
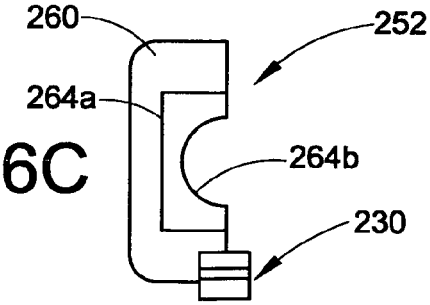
Figure 6D:
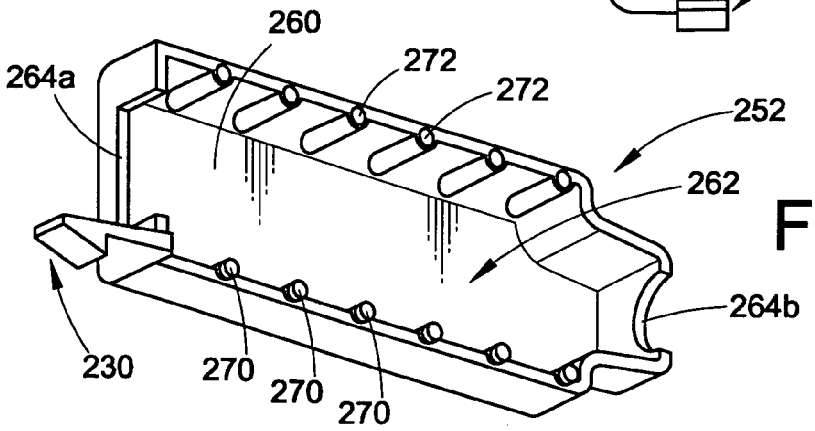

FIG. 4 shows the locking connector 210 mated with the conventional female connector 14 of the electrical device M, with the locking prongs 230*a*,230*b* thereof engaged with the peripheral edge 14*e* of the female connector 14. FIG. 5 provides details of the engagement of a USB locking connector 110,210 with a conventional female connector 14 (the connector shown in FIG. 5 is the connector 110, but the connector 210 operates in the same manner as will be apparent to those of ordinary skill in the art). In FIG. 5, it can be seen that when the locking connector 110 is mated with the conventional female Type B USB connector 14, the male plug portion 122 is received into the hexagonal receiver 14*p*1, and the rectangular stud 14*p*2 of the female side is received into the male plug portion 122. During the process of mating the locking connector 110 with the connector 14, the ramp surfaces 134*r* of the first and second locking prongs 130*a*,130*b* engage the peripheral edge 14*e* of the housing H which causes the prongs to deflect toward each other, until the ramp surfaces 134*r* move axially inward beyond the edge 14*e* so that the locking prongs 130*a*,130*b* are able to move resiliently away from each other to the illustrated position, where their respective locking faces 134*f* are captured behind the peripheral edge 14*e* of the housing H. The locking faces 134*f* are sized and shaped so that, when the connector 210 is pulled intentionally to disconnect from the female connector 14, the locking prongs 130*a*,130*b* are again deflected toward each other, which allows the locking faces to disengage from the edge 14*e* so that the locking connector 110 can be disconnected from the female connector 14. As noted, the locking prongs 230*a*,230*b* of the connector 210 engage the edge 14*e* in the same manner when mated with the female connector 14.

Figure 7:
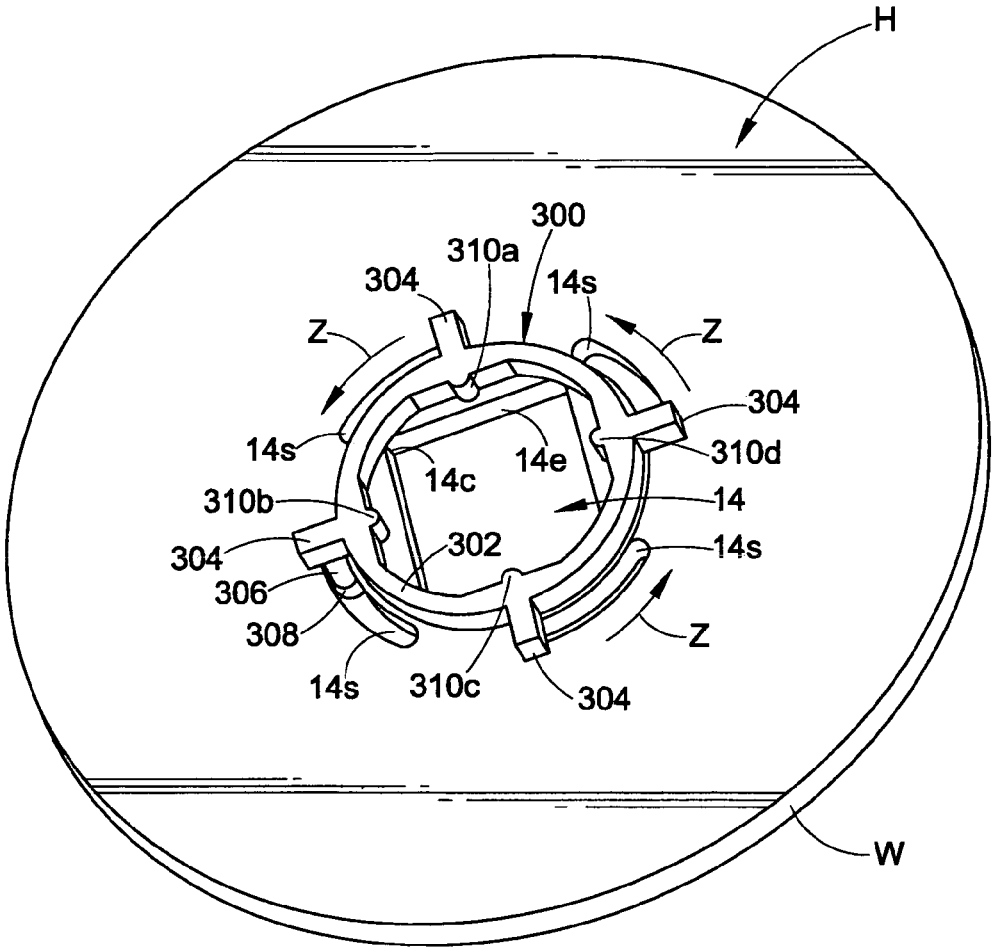
FIG. 7 illustrates a USB locking connector formed in accordance with another alternative embodiment of the present development.

FIG. 7 illustrates a locking USB connector 300 formed in accordance with another embodiment of the present development. A housing H of an electronic component includes a conventional female Type B USB connector 14 as described above. The housing H further comprises the locking connector 300 as a part thereof. The locking connector comprises a lock ring 302 that is manually movable between an unlocked position (FIGS. 7, 8A) and a locked position (FIG. 8B). The lock ring 302 lies adjacent and at least substantially encircles the peripheral edge 14*e* of the female connector 14. When the lock ring 302 is located in the unlocked position, a conventional male Type B USB connector 10 is able to be mated with and disconnected from the female connector 14 without interference, i.e., the lock ring 302 does not obstruct the connector 14. When a conventional male Type B USB connector is mated with the female connector 14, the lock ring 302 can be moved to its locked position as shown in FIG. 8B, so that the lock ring frictionally engages the conventional male Type B USB connector 10 and inhibits disconnection of same from the female connector 14. In its locked position, the lock ring 302 partially obstructs the female connector 14, to capture a mating male connector 10.

More specifically, the housing H which is a metal or molded polymeric construction, comprises a wall W that defines a plurality of arcuate slots 14*s* that are spaced around the edge 14*e* of the female connector 14. The lock ring 302 comprises a corresponding plurality of spokes 304, each of which includes a projecting leg 306 with an enlarged end 308 (only one of the legs 306 is visible in FIG. 7). The lock ring 302 is connected to the housing by forcing the enlarged end 308 of each leg 306 through a respective one of the slots 14*s*, so that the enlarged end 308 of each leg is captured behind the wall W (on the side opposite the lock ring 302), with the leg 306 slidable in the slot as indicated by the arrows Z to move the lock ring 302 from its unlocked position to its locked position, and in the opposite direction. The legs 306 are dimensioned so that the lock ring 302 is held closely adjacent the housing H when the legs 306 are captured in the slots 14*s*.

The lock ring 302 further comprises at least one and preferably four locking nibs 310*a*,310*b*,310*c*,310*d* that project radially inward from the lock ring 302 toward a center of the female connector 14. The nibs 310*a*-310*d* are preferably arranged symmetrically about the peripheral edge 14*e*, and are located so as to be located respectively adjacent the midpoints of the four linear sides of the peripheral edge 14*e* when the lock ring 302 is unlocked and so as to be located respectively adjacent the four corners 14*c* of the edge 14*e* when the lock ring 302 is moved to its locked position (FIG. 8B). The nibs 310*a*-310*d* preferably do not extend from the lock ring 302 beyond the edge 14*e* when the lock ring 302 is unlocked so as not to interfere with connection/disconnection of an associated male connector 10. On the other hand, when the lock ring 302 is locked, the nibs 310*a*-310*d* project from the lock ring 302 beyond the corners 14*c* of peripheral edge 14*e* into the space to be occupied by the body 20 of a male connector 10.

Figure 8A:
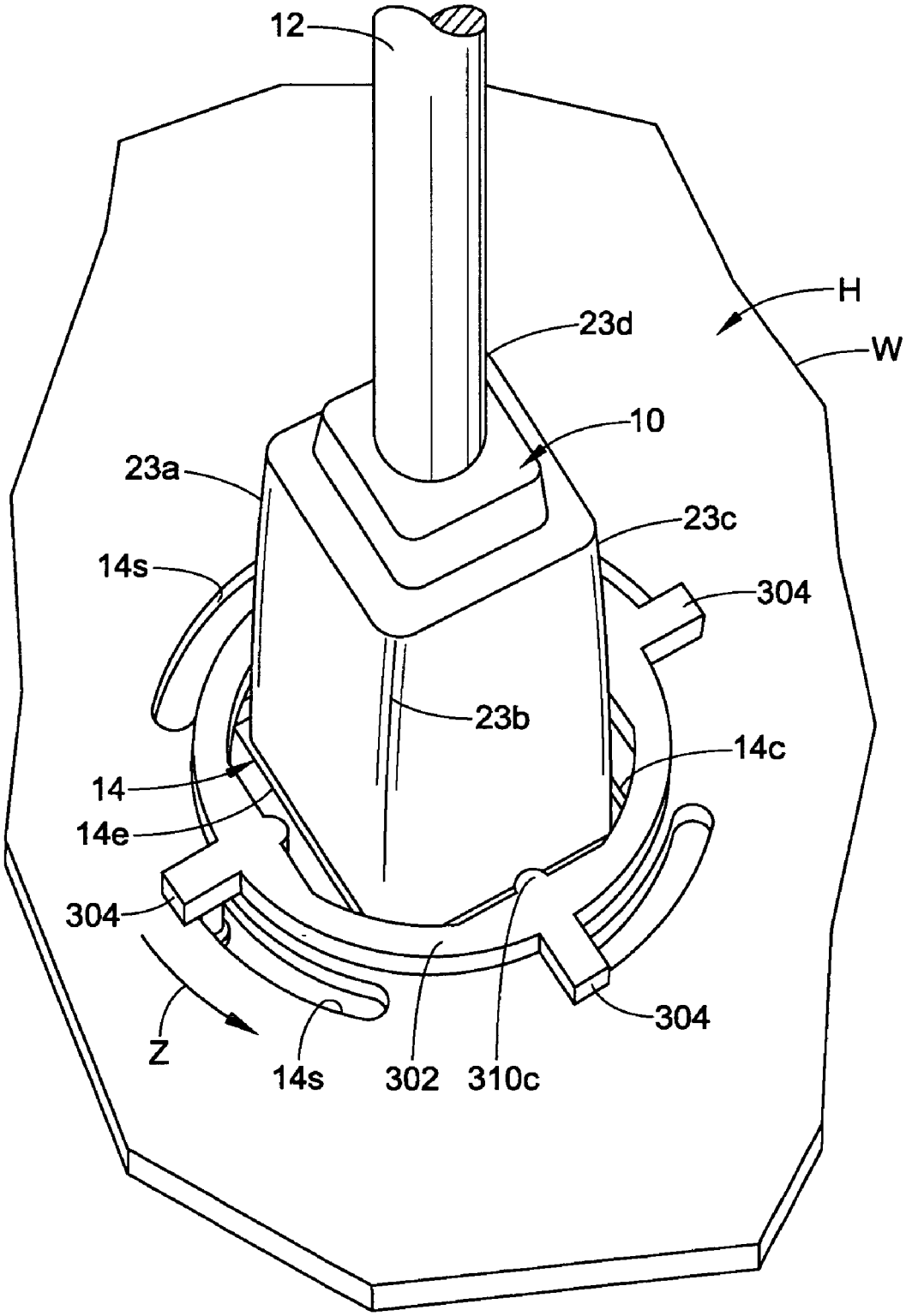
FIG. 8A shows the USB locking connector of FIG. 7 and also shows a conventional male Type B connector mated therewith, with the USB locking connector arranged in its unlocked position.
Figure 8B:
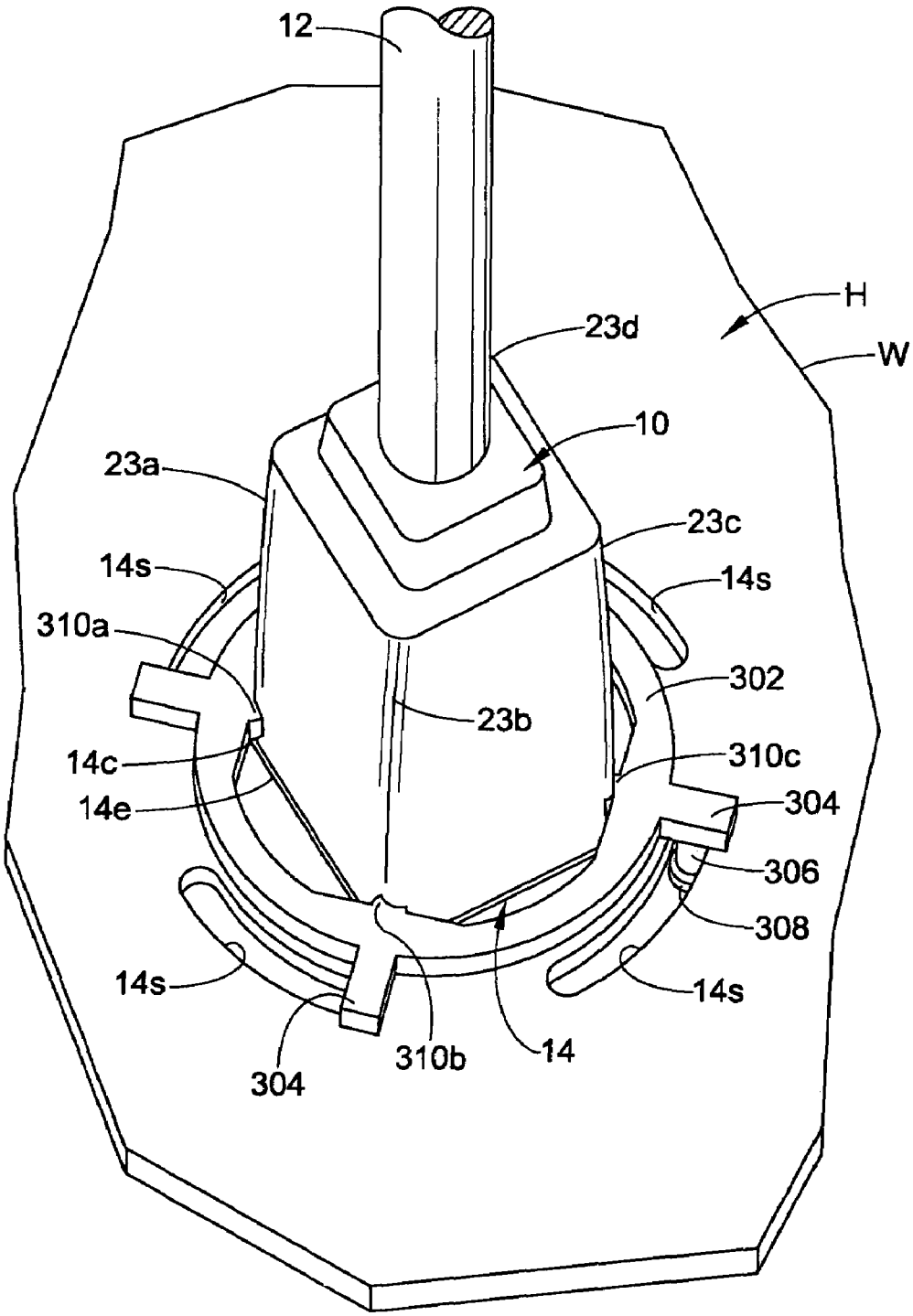
FIG. 8B is similar to FIG. 8A, but shows the USB locking connector arranged in its locked position.

With specific reference now to FIGS. 8A and 8B, to operate the locking connector 300, a conventional male Type B USB connector 10 is mated with the female connector 14 when the lock ring 302 is unlocked as shown in FIG. 8A. The lock ring is then rotated to its locked position as indicated by the arrow Z so that the locking nibs 310*a*-310*d* frictionally engage the respective corners 23*a*,23*b*,23*c*,23*d* (see also FIG. 1B) of the connector body 20. The locking ring 302 is preferably defined from as a molded polymeric construction so that, when it is moved from the unlocked to the locked position to engage a male connector 10, the otherwise circular locking ring 302 resiliently ovalizes when the locking nibs encounter the corners 23*a*-23*d* of the connector body 20. Frictional engagement between the nibs 310*a*-310*d* and the connector body 20 inhibits unintentional disconnection of the male connector 10 from the female connector. When disconnection is desired, the lock ring 302 is rotated from the locked position to the unlocked position, whereupon it resiliently assumes its original circular shape.

The invention has been described with reference to preferred embodiments. Modifications and alterations will occur to those of ordinary skill in the art, and it is intended that the claims be construed literally and/or according to the doctrine or equivalents to encompass all such modifications and alterations.

The invention claimed is:

1. A USB connector locking device comprising:

a cable;

a male USB connector connected to said cable, said male USB connector comprising: (i) a polymeric body connected to the cable, said body comprising a main portion and a cable interface portion that interconnects the main portion to the cable; and, (ii) a male USB plug that projects axially from the main portion of the body, wherein a shoulder is defined between said male plug and said main portion of the body;

a housing comprising first and second clamshell components that are fit together around and encase said polymeric body, wherein said first clamshell component comprises a first locking prong extending therefrom axially alongside and spaced from a first lateral side of said male USB plug, and wherein said second clamshell component comprises a second locking prong extending therefrom axially alongside and spaced from a second lateral side of said male USB plug, wherein said first and second locking prongs are each resiliently deflectable toward and away from the male plug;

wherein each of said locking prongs comprises: (i) a leg having an outer end spaced axially from the shoulder; (ii) an enlarged tooth defined at said outer end of said leg, said enlarged tooth comprising an inclined ramp surface that is arranged to converge from a highest point toward an outermost end of the male plug as it extends axially away from the shoulder of the body portion, and comprising a transverse locking face that terminates the ramp surface at the highest point;

wherein said first and second clamshell components comprise mirror image structures relative to each other.

2. The USB locking connector locking device as set forth in claim 1, wherein said first and second clamshell components each comprise a plurality of locking studs and a plurality of locking stud receivers, wherein the locking studs of the first clamshell component are received into and retained by the locking stud receivers of the second clamshell component, and vice versa.

3. The USB connector locking device as set forth in claim 2 further comprising:

a mating female USB connector, wherein said USB locking connector is mated with the female connector, with said male plug received into a hexagonal receiver of the female connector and with a rectangular stud of the female connector received into the male plug, and wherein said locking faces of said first and second locking prongs are captured behind a peripheral edge of a housing in which said female connector is located.

4. A USB connector locking system comprising:

a female USB connector installed in a housing, said female USB connector comprising an inner plug portion located within a recess that is bounded by a peripheral edge defined in a wall of the housing, with a space defined between the Inner plug portion and the peripheral edge;

a lock ring rotatably connected to said wall of said housing adjacent and surrounding the peripheral edge of the female USB connector, said lock ring manually rotatable between an unlocked position and a locked position, wherein said lock ring, when located in its unlocked position allows unobstructed disconnection of an associated male USB connector from the female USB connector, and wherein said lock ring, when moved to its locked position, frictionally engages the associated male USB connector that is mated with the female USB connector to inhibit disconnection of the associated male USB connector from the female USB connector;

said lock ring comprising a plurality of locking nibs that project radially inward toward a center of the female USB connector, wherein said plurality of locking nibs are spaced from the associated male USB connector when said lock ring is located In its unlocked position, and wherein said plurality of locking nibs frictionally engage respective portions of the associated male USB connector when the lock ring is located in its locked position and exert a deforming force on said lock ring to ovalize said lock ring when said lock ring is located in its locked position and said locking nibs are engaged with the associated male USB connector.

5. The USB connector locking system as set forth in claim 4, wherein said wall of said housing defines a plurality of arcuate slots, and wherein said lock ring comprises a plurality of legs that are respectively slidably located in said plurality of arcuate slots, and wherein said lock ring is rotated about said female USB connector to and between its unlocked and locked positions.

6. The USB connector locking system as set forth in claim 5, wherein each of said plurality of legs comprises an enlarged end that is trapped behind said wall of said housing to capture the lock ring to the wall.

7. The USB connector locking system as set forth in claim 6, wherein said lock ring comprises a plurality of spokes that project radially outward therefrom, each of said plurality of legs is connected to one of said spokes.

8. The USB connector locking system as set forth in claim 4, wherein said peripheral edge of said female connector comprises four linear sides and four corners, and wherein said lock ring comprises four locking nibs located adjacent and spaced symmetrically about said peripheral edge, said locking nibs located between said four corners when said lock ring is located in its unlocked position, said locking nibs located adjacent said four corners when said lock ring is located in its locked position.

* * * * *